US005903293A

United States Patent [19]

Nikkels et al.

[11] Patent Number: 5,903,293

[45] Date of Patent: May 11, 1999

[54] INK-JET BOTTLE AND VALVE SYSTEM

[75] Inventors: Ben H. Nikkels, Pitman; Richard T. Reeves, Laurel Springs, both of N.J.

[73] Assignee: Graphic Controls Corporation, Buffalo, N.Y.

[21] Appl. No.: 08/650,768

[22] Filed: May 20, 1996

[51] Int. Cl.[6] ..... B41J 2/175

[52] U.S. Cl. ..... 347/86; 347/85

[58] Field of Search ..... 429/55; 347/85, 347/86; 222/92

[56] References Cited

U.S. PATENT DOCUMENTS

| | | | |
|---|---|---|---|
| 3,005,578 | 10/1961 | Mainieri . | |
| 3,184,782 | 5/1965 | Armour . | |
| 3,205,923 | 9/1965 | Wilson . | |
| 3,598,150 | 8/1971 | Nolan . | |
| 3,930,761 | 1/1976 | Barrachough . | |
| 4,084,165 | 4/1978 | Skafvenstedt et al. | 347/6 |
| 4,123,761 | 10/1978 | Kimura et al. . | |
| 4,162,501 | 7/1979 | Mitchell et al. . | |
| 4,183,031 | 1/1980 | Kyser et al. . | |
| 4,287,523 | 9/1981 | Thomas et al. . | |
| 4,333,088 | 6/1982 | Diggins . | |
| 4,359,744 | 11/1982 | Salmre . | |
| 4,376,283 | 3/1983 | Bower . | |
| 4,511,906 | 4/1985 | Hara . | |
| 4,593,294 | 6/1986 | Parisi . | |
| 4,603,714 | 8/1986 | Marotta . | |
| 4,626,874 | 12/1986 | Murai et al. . | |
| 4,653,672 | 3/1987 | Tuerk et al. . | |
| 4,676,287 | 6/1987 | Fitzwater . | |
| 4,700,202 | 10/1987 | Kuranishi et al. . | |

(List continued on next page.)

FOREIGN PATENT DOCUMENTS

| | | |
|---|---|---|
| 0 722 837 | 7/1996 | European Pat. Off. . |
| 0 771 663 | 10/1996 | European Pat. Off. . |
| 0 794 058 | 9/1997 | European Pat. Off. . |
| 63-3959 | 1/1988 | Japan . |
| WO 93/18920 | 9/1993 | United Kingdom . |

OTHER PUBLICATIONS

European Search Report Dated Sep. 3, 1998.

Edds et al., Antiwetting Treatment for Fluid Container Walls, IBM Technical Disclosure Bulletin, pp. 3201–3202, Jan. 1978.

*Primary Examiner*—N. Le
*Assistant Examiner*—Michael Nghiem
*Attorney, Agent, or Firm*—Ratner & Prestia

[57] ABSTRACT

An ink-jet bottle and valve system which delivers ink-jet ink to an ink-jet printer apparatus having an ink reservoir. The system has five, main components: (1) a bottle, (2) a housing, (3) a valve, (4), a cover, and (5) a vent tube. Coupled to the ink reservoir, the housing has a nozzle which extends into the ink reservoir and defines a channel through which ink may flow from the bottle to the ink reservoir. The top surface of the housing has a cutout defining a pair of valve rotation stops. The housing also has a bottom surface which includes a lower vent and a lower ink passage each opening to the channel of the nozzle. The valve fits snugly and rotatably within the housing. The internal surface of the valve is threaded to couple the valve to the threaded neck of the bottle. The bottom surface of the valve has an upper vent and an upper ink passage. Finally, a top surface of the valve has a projecting tab. The tab rests in the cutout of the housing and cooperates with the pair of valve rotation stops to limit axial rotation of the valve within the housing between (i) a first position where the tab abuts one valve rotation stop and in which the upper vent and the upper ink passage of the valve align with the lower vent and the lower ink passage, respectively, of the housing, and (ii) a second position where the tab abuts the other valve rotation stop and in which the upper vent and the upper ink passage of the valve are out of alignment with the lower vent and the lower ink passage, respectively, of the housing. The cover engages a flange on the housing and captivates the valve within the housing. Finally, the vent tube allows air, required to equalize the pressure in the bottle, to pass directly to the area at the top of the bottle above the ink and assure even ink flow.

20 Claims, 5 Drawing Sheets

U.S. PATENT DOCUMENTS 4,925,068 5/1990 Schneider .
4,930,668 6/1990 Krall .
5,058,778 10/1991 Weinstein .
5,108,015 4/1992 Rauworth et al. .
5,190,643 3/1993 Duncan et al. .
5,199,617 4/1993 Bennett .
5,258,243 11/1993 Cannone ..... 429/55
5,299,608 4/1994 Bosyj .
5,343,226 8/1994 Niedermeyer et al. .
5,366,115 11/1994 Kersten et al. .
5,425,479 6/1995 Credle, Jr. ..... 222/92

INK-JET BOTTLE AND VALVE SYSTEM

FIELD OF THE INVENTION

This invention relates to impulse ink-jet printers and, more specifically, to an ink-jet bottle and valve system used to supply such a printer with ink.

BACKGROUND OF THE INVENTION

One of the most common types of printers in the field of non-impact printing has been the ink-jet printer. An ink-jet printer emits a stream of ink droplets from an orifice in response to received signals. Several different types of ink-jet printers are known. Chief among these types are printers in which a continuous stream of droplets is emitted from the orifice of the ink jet. Those droplets not required for printing are electrostatically deflected and (typically) recycled for re-emission. Another type of ink-jet printer is the "impulse" type, in which the ink droplets are emitted only in response to print commands. The present invention is applicable to both types of ink-jet printers. In its preferred embodiment, however, the present invention relates to the impulse type of ink-jet printer.

When the performance of a non-impact printer like the ink-jet printer is compared with that of an impact printer, one of the problems encountered with the non-impact machine has been obtaining and maintaining the required control over the printing operation. The related problem of maintaining an adequate supply of ink in the print head, while pulsing the ink fluid to provide droplets of ink in a successive manner during the printing operation, must be overcome to control the impulse ink-jet printing operation. Any ink-jet printer necessarily requires a replenishing of the ink supply and the requirements of the ink-jet printer dictate the design of the ink supply system.

Impulse ink-jet printers which provide droplets of ink on demand in response to the state of energization of a transducer are typically supplied with in from relatively small cartridges because the volume of ink consumed in an impulse ink-jet printer is often relatively small. But certain industrial applications of impulse ink-jet printers require large volumes of ink over extended periods of time. For example, on-line printing of corrugated containers may require a plurality of ink-jet print heads. Each print head has a large number of jets to produce relatively large characters, bar codes, or both. Under these circumstances, a large volume of ink is used for a long time and the use of small cartridges becomes impractical. For printing in this type of application, therefore, a relatively large ink supply is necessary; a container holding 125, 250, 500, or 1000 milliliters may be necessary. The use of such a large ink supply poses certain problems for an impulse ink-jet printer.

First, the process of replenishing the ink supply for an ink-jet printer requires an operator to disconnect the supply from the ink-jet printer and replace the supply. The ink-jet itself, which is relatively expensive, remains permanently mounted on the scanning head of the receiver so as to assure proper droplet placement. One drawback with ink-jet printers in commercial application is the difficulty associated with maintenance of the ink jet and related apparatus (including the ink supply) by relatively unskilled operators or attendants. Accordingly, the operator must be able to install the ink supply into the printing system, by attaching the ink supply to the printer and opening the ink supply to the ink stream, with a minimum of effort.

Often, the ink supply system must be changed before all of the ink contained in the system is used. This usually occurs when the operator wants to assure that the ink supply does not run dry during a printing operation. This may occur, too, if a new color or a different type of ink is required in the application for which the ink-jet printer will be used. Therefore, the ink supply system must permit removal of partially filled containers, without spillage creating a mess, as well as assure an ecologically sound refilling policy.

Third, an impulse ink-jet printer must be primed with ink in order to operate properly. Printing of an impulse ink jet requires that positive pressure be generated in connection with the supply of ink so as to force the ink through the ink-jet chamber and the orifices of the ink jet while preventing ink from being sucked back through the orifices and the chambers upon completion of printing. Accordingly, the ink must dispense from the ink supply smoothly and without interruption to avoid affecting adversely the performance of the printer. The flow of ink must be shut off at some level, of course, to prevent over-filling.

Finally, ink-jet printers must be purged occasionally to remove dried ink or other debris from the orifice or nozzle of the ink jet. Because the orifice or nozzle of the ink jet is extremely small and its size is of the utmost importance in the formation of ink droplets which emerge from the jet, it will be readily appreciated that the orifice must be kept clear of any debris which might interfere with that droplet-forming function. It will further be appreciated that the ink-delivery system for the ink-jet printer must contain ink in a sealed and clean environment devoid of debris. The system must prevent contamination of the ink.

Despite the advantages of ink-jet printers, further commercial acceptance of marking by ink jet awaits improvement of the system by which ink is delivered to the ink-jet printer. Others have attempted to improve ink delivery systems. U.S. Pat. No. 5,343,226 represents one such attempt; the '226 patent is directed to an ink-jet ink supply apparatus. An ink reservoir has a port for releasing ink to a tube which supplies ink jets. The ink is supplied to the reservoir from a container through an opening in the cover of the container. The opening is located in a neck which extends upwardly from the cover and includes threads. The container has a threaded cap which engages the threads on the neck of the cover to attach the container to the ink reservoir. A vent opening (which appears to be permanently open) is provided in the cover.

As best illustrated in FIGS. 9–11 of the '226 patent, a valve mechanism is mounted in the opening in the cover of the container. The valve mechanism interrupts gravity feed of ink from the container into the ink reservoir. A valve actuator or projection is formed in the base of the ink reservoir. A cap projection on the container has an opening which extends into the base and aligns with the actuator. The cap of the container has a plunger which is biased in a closed position by a spring encircling a shaft of the plunger. The valve mechanism is opened automatically, and ink is permitted to flow from the container to the reservoir, when the container is mounted on the base of the reservoir. The spring forces the plunger closed so as to prevent the flow of ink from the container when the container is not mounted on the reservoir base.

The ink-jet ink supply apparatus taught by the '226 patent is relatively complex, expensive, and may be difficult to implement in a variety of applications. Specifically, the apparatus has a number of moving parts—including a spring, plunger, and shaft—which may require maintenance and may fail. Such moving parts also preclude the assurance of repeatable shutoffs. The apparatus stops the flow of ink through a vertical closure action which does not provide a "wiping" action and, therefore, risks ink leakage. Should debris prevent the plunger from seating precisely, an insufficient ink seal might be obtained. In addition, the user must overcome the spring force to screw the ink supply apparatus to the ink-jet printer. Finally, removing a partially filled bottle of ink may cause leakage because the bottle must be largely unthreaded before the valve closes.

Industrial ink-jet applications require specialized ink delivery systems. To overcome the shortcomings of existing impulse ink-jet ink delivery systems, a new ink-jet bottle and valve system is provided. An object of the present invention is to provide a large ink supply for an impulse ink-jet printer which can be removed from that printer. Another object is to provide an ink delivery system that contains ink in a sealed and clean environment. A related object is to provide a system that prevents contamination of ink. Yet another object is to provide a system which is reliable, easy to use, and avoids material compatibility problems.

It is still another object of the present invention to substantially eliminate the possibility of any spillage of ink. An additional object is to provide an ink delivery system which is entirely compatible with existing ink-jet printers. A related object is to provide a system which dispenses ink without affecting the performance of the printer. Yet another related object of this invention is to provide a system that, when installed into the ink-jet printer, attaches to the printer and opens to the ink stream with a um of operator effort. An additional object is to provide a valve system which closes fully before the bottle disengages from the reservoir, thereby preventing spillage of ink during bottle removal.

SUMMARY OF THE INVENTION

To achieve these and other objects, and in view of its purposes, the present invention provides an ink-jet bottle and supply system which delivers ink-jet ink to an ink-jet printer apparatus having an ink reservoir. The ink-jet bottle and supply system has five, main components: (1) a bottle, (2) a housing, (3) a valve, (4), a cover, and (5) a vent tube. The bottle contains replacement ink-jet ink and has a threaded neck defining an opening for dispensing the ink from the bottle. The housing has a nozzle which extends into the ink reservoir of the ink-jet printer apparatus and defines a channel through which ink may flow. The external surface of the housing is threaded to couple the housing to corresponding threads on the ink reservoir of the ink-jet printer apparatus. The internal surface of the housing defines an open chamber. The top surface of the housing has a cutout defining a pair of valve rotation stops. Finally, the housing has a bottom surface which includes a lower vent and a lower ink passage each opening to the channel of the nozzle.

The valve fits snugly and rotatably within the open chamber of the housing. The internal surface of the valve is threaded to couple the valve to the threaded neck of the bottle. The bottom surface of the valve has an upper vent and an upper ink passage. Finally, the top surface of the valve has a projecting tab. The tab rests in the cutout of the housing and cooperates with the pair of valve rotation stops to limit axial rotation of the valve within the housing between (1) a first position where the tab abuts one valve rotation stop and in which the upper vent and the upper ink passage of the valve align with the lower vent and the lower ink passage, respectively, of the housing, and (2) a second position where the tab abuts the other valve rotation stop and in which the upper vent and the upper ink passage of the valve are out of alignment with the lower vent and the lower ink passage, respectively, of the housing.

The cover has a central hole which fits loosely over the neck of the bottle. A pair of view windows are provided in the top of the cover. These view windows align with the indicator on the top of the tab and confirm the position of the valve relative to the housing. The cover engages the flange on the housing and captivates the valve within the housing.

Finally, a vent tube is affixed to the upper vent of the valve. The top of the vent tube is disposed above the ink-jet ink contained in the bottle. The vent tube allows air, required to equalize the pressure in the bottle, to pass directly to the area at the top of the bottle above the ink. This allows the ink to fill the in reservoir of the printer apparatus evenly and quickly. It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
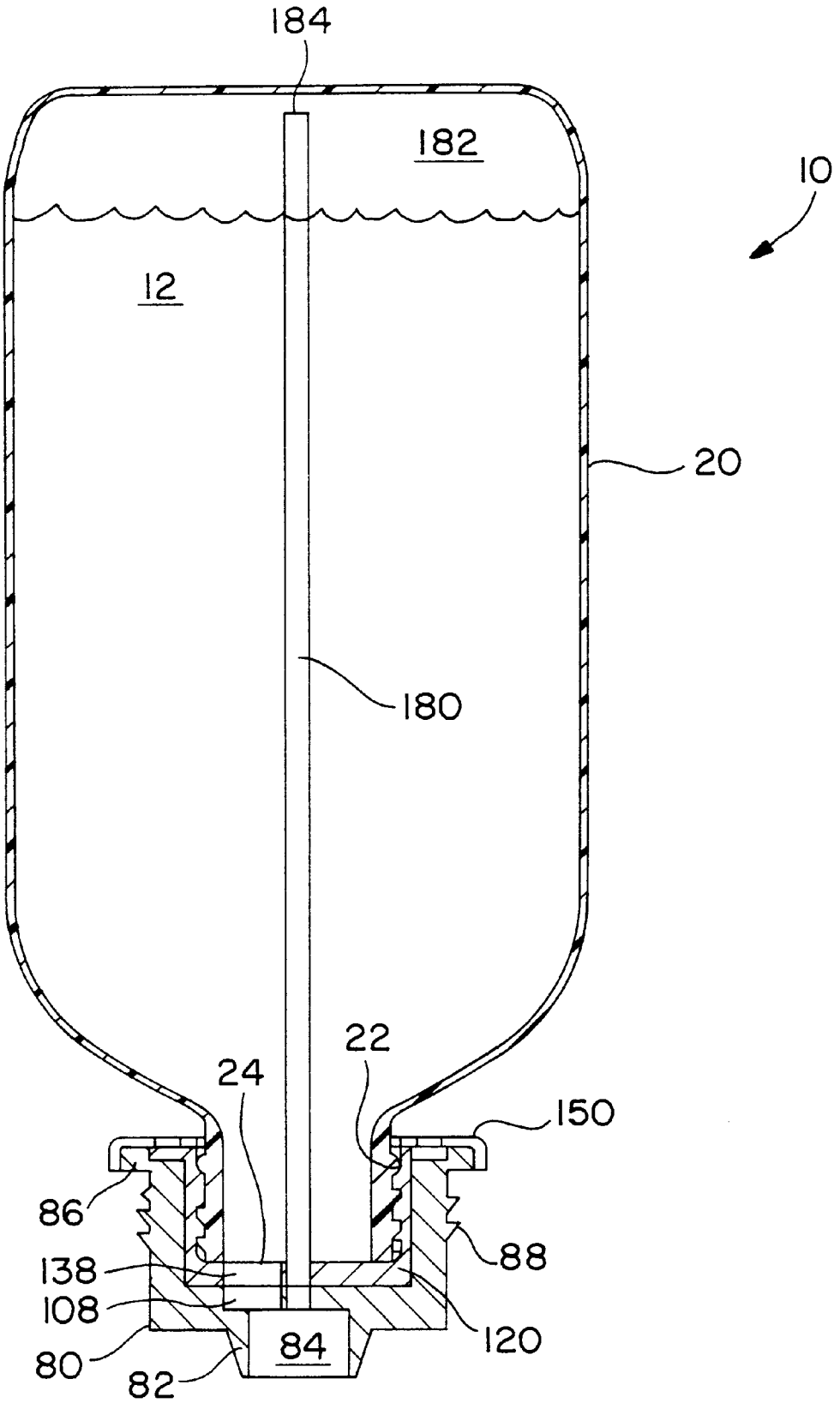
FIG. 1 is a cross-sectional view of the assembled ink-jet bottle and valve system according to the present invention.

Referring now to the drawing, it is emphasized that, according to common practice, the various components of the drawing are not to scale. On the contrary, the width, length, and thickness of the various components are arbitrarily expanded or reduced for clarity. Like reference numerals refer to like components throughout the drawing.

As illustrated in FIG. 1, the ink-jet bottle and valve system 10 according to the present invention has five, main components: (1) a bottle 20, (2) a housing 80, (3) a valve 120, (4), a cover 150, and (5) a vent tube 180. Together, housing 80, valve 120, cover 150, and vent tube 180 define a valve assembly. Ink-jet bottle and valve system 10 is used to contain and dispense ink 12.

Bottle 20 is a vessel with an attachment mechanism, such as external threads 22, and an opening 24 at one end. Bottle 20 is preferably translucent, with graduations, permitting the user to validate ink color and level. For example, bottle 20 may be made of high-density polyethylene. The valve assembly joins bottle 20 by external threads 22 and covers opening 24. Bottle 20 and the valve assembly may be screwed together. It may also be desirable to secure bottle 20 to the valve assembly using an adhesive or other relatively permanent attachment medium discussed more fully below.

Figure 2:
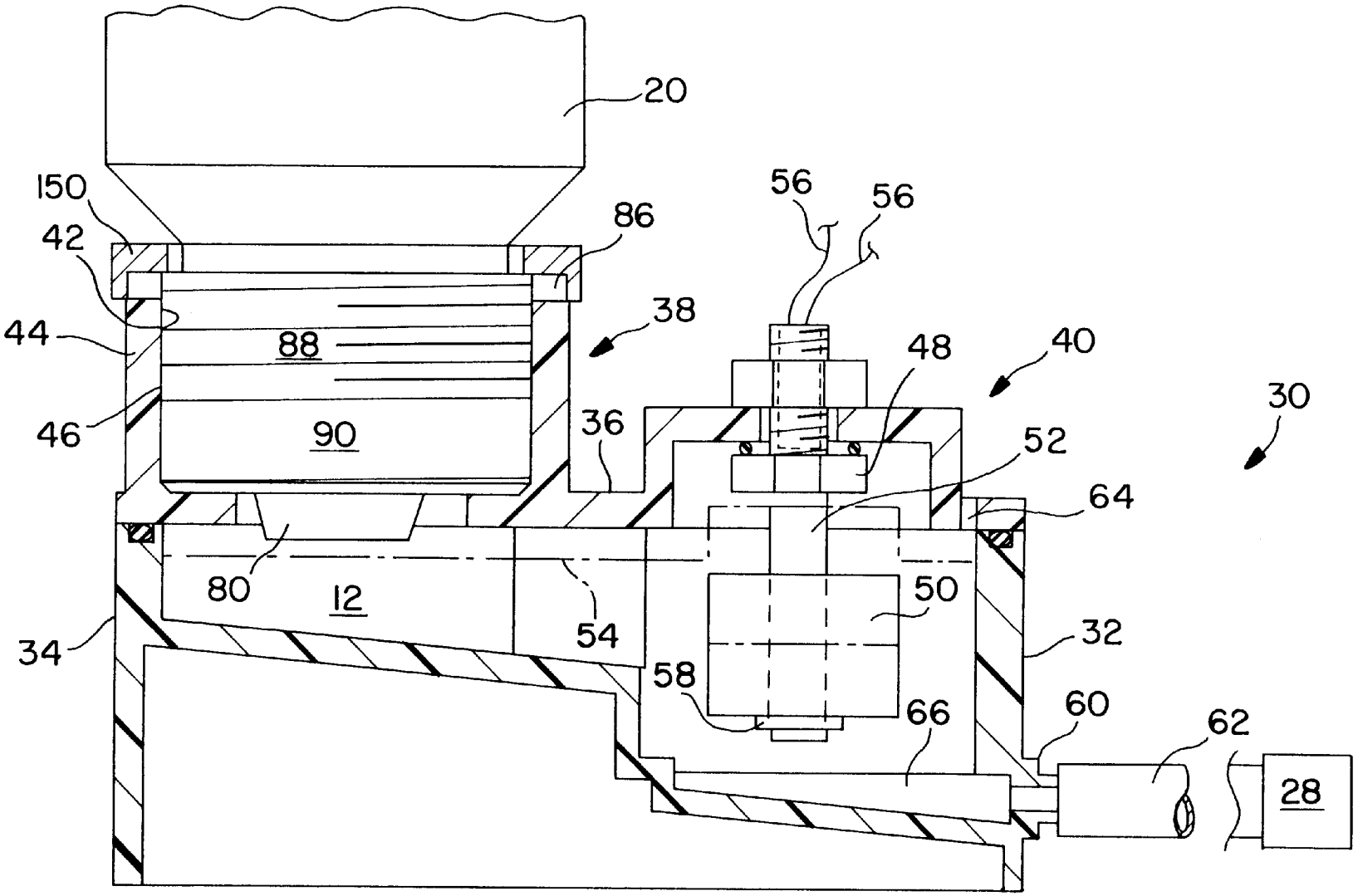
FIG. 2 is a cross-sectional view of the ink-jet bottle and valve system according to the present invention as assembled to an ink-jet printer apparatus.

FIG. 2 shows ink-jet bottle and valve system 10 as assembled to a conventional ink-jet printer apparatus 30. Ink-jet bottle and valve system 10 supplies ink to apparatus 30 and has fewer moving parts than present systems. Springs are specifically avoided. Apparatus 30 has an ink supply base 34 defining an ink reservoir 32 which permits a relatively large supply of ink 12 to be used and permits the print head 28 to be primed in an efficient, ecologically sound, and easy manner. Ink supply base 34 includes a head 36 having a container support portion 38 and a level detect portion 40. Container support portion 38 includes an aperture 42 in head 36 which extends upwardly and is adapted to receive ink-jet bottle and valve system 10, including bottle 20. Aperture 42 is located in a neck 44 which extends upwardly from head 36 and includes threads 46 for receiving the threaded portion 88 on housing 80 of ink-jet bottle and valve system 10.

Level detect portion 40 in head 36 includes a level detect mechanism 48 which is mounted on head 36. As shown, mechanism 48 includes a float 50 which is free to move along the shaft 52 (to the position shown in phantom) and a magnet (not shown) located in an internal opening of float 50 which actuates a proximity switch (not shown) to signal the level 54 of ink 12 within ink reservoir 32 formed by ink supply base 34. The signal wires 56 are coupled to the proximity switch as shown. A washer 58 holds float 50 on shaft 52. A level detect device of this type is sold by Signal Systems International under the trade name FS2-B Liquid Level Switch.

A flexible tube 62 couples ink reservoir 32 to print head 28. A port 60 in ink supply base 34 is provided which may be coupled to tube 62 as shown in FIG. 2. Port 60 may actually be located in a separate fitting. A vent opening 64 is also provided in the top of head 36 as shown or may be provided elsewhere. A filter 66 is shown in ink supply base 34 adjacent to port 60.

Figure 3A:
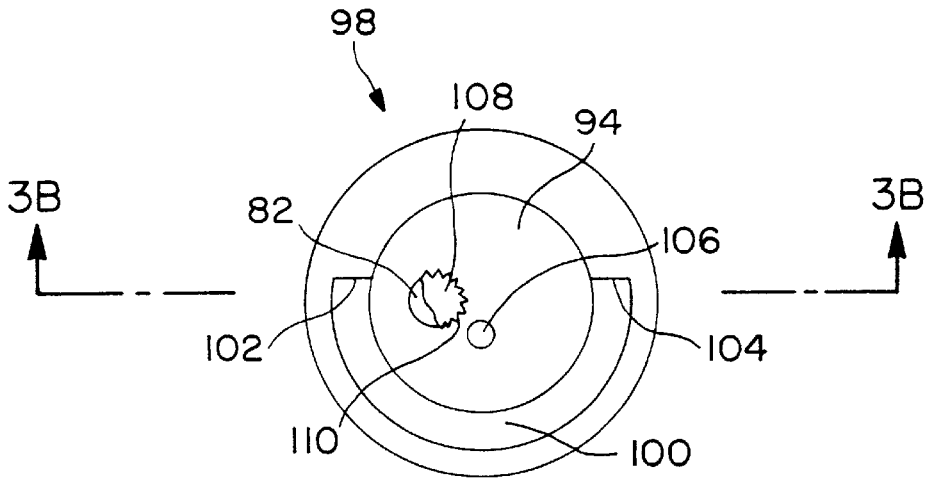
FIG. 3A is a top view of the housing of the ink-jet bottle and valve system according to the present invention.
Figure 3B:
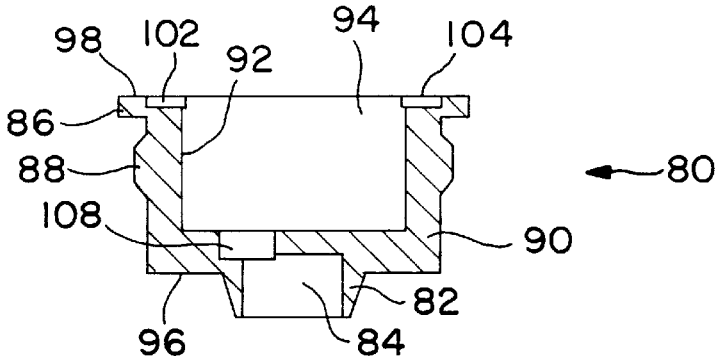
FIG. 3B is a cross-sectional view of the housing of the ink-jet bottle and valve system according to the present invention taken along the line 3B—3B of FIG. 3A.
Figure 3C:
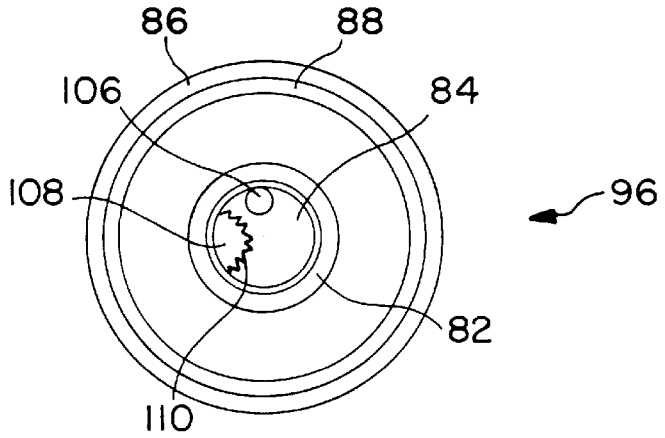
FIG. 3C is bottom view of the housing of the ink-jet bottle and valve system according to the present invention.

FIGS. 3A, 3B, and 3C provide details about the elements of housing 80 of ink-jet bottle and valve system 10. Housing 80 is a cylindrical component made of hard plastic or other suitable material compatible with the inks used in ink-jet printers. A nozzle 82 is provided on the bottom surface 96 of housing 80 and extends about 5 mm below bottom surface 96. As shown in FIGS. 3B and 3C, nozzle 82 may be tapered. Nozzle 82 defines a central channel 84 with, for example, a diameter of about 13 mm. On the top surface 98 of housing 80, a flange 86 is provided. The cylindrical surface of housing 80, which extends between bottom surface 96 and top surface 98 of housing 80, has an external threaded portion 88 (about 10 mm high) adjacent top surface 98 and an external smooth portion 90 (also about 10 mm high) adjacent bottom surface 96. The inside surface 92 of the cylindrical surface of housing 80 is smooth and defines an open chamber 94 having a diameter of about 30 mm.

As illustrated in FIG. 2, threaded portion 88 on housing 80 engages threads 46 inside aperture 42 of neck 44 of printer apparatus 30 to join ink-jet bottle and valve system 10 to printer apparatus 30. Bottom surface 96 limits the depth to which ink-jet bottle and valve system 10 screws into printer apparatus 30. Thus, bottom surface 96 prevents over-rotation of housing 80 relative to printer apparatus 30. When ink-jet bottle and valve system 10 is secured filly to printer apparatus 30 and bottom surface 96 just contacts head 36 of container support portion 38 of printer apparatus 30, nozzle 82 extends into ink reservoir 32 of printer apparatus 30 and connects the vent and ink paths (defined below) to ink reservoir 32. When ink level 54 in ink reservoir 32 reaches the bottom of nozzle 82, the ink path and vent seal off. This stops the further transfer of ink 12 from ink-jet bottle and valve system 10 to printer apparatus 30. As the level of ink 12 drops below nozzle 82, ink 12 from bottle 20 restores ink level 54 in ink reservoir 32 to the shut-off point. This prevents ink 12 in bottle 20 from over-filling ink reservoir 32 of printer apparatus 30.

Top surface 98 of housing 80 is provided with a cutout 100. The opposite ends of cutout 100 define a pair of valve rotation stops 102, 104. As shown in FIG. 3A, cutout 100 may traverse about one-half (180 degrees) of the circumference of top surface 98. Valve rotation stops 102, 104 may be about 1–2 mm high.

Bottom surface 96 of housing 80 is provided with a lower vent 106 and a lower ink passage 108. Lower vent 106 is circular (although other shapes are suitable) and about 5 mm in diameter. Lower ink passage 108 is also circular (although other shapes may work) and about 5 mm in diameter. Both lower ink passage 108 and lower vent 106 are located as shown in FIGS. 3A and 3C. Specifically, both are off-center. Lower ink passage 108 may be partially covered by nozzle 82 and may be provided with serrations 110 around at least that portion of lower ink passage 108 not covered by nozzle 82. Serrations 110 function to break any meniscus that ink 12 might form and, thereby, facilitate even and continuous flow of ink 12.

Figure 4A:
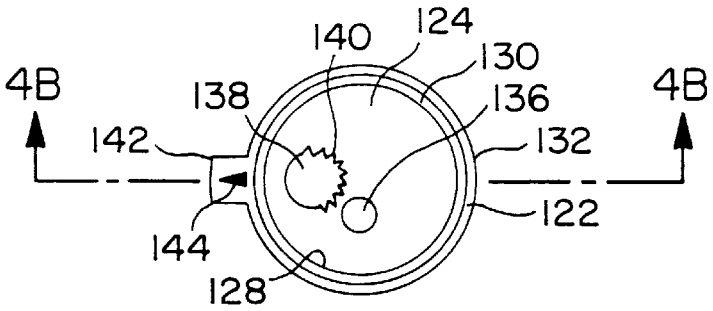
FIG. 4A is a top view of the valve of the ink-jet bottle and valve system according to the present invention.
Figure 4B:
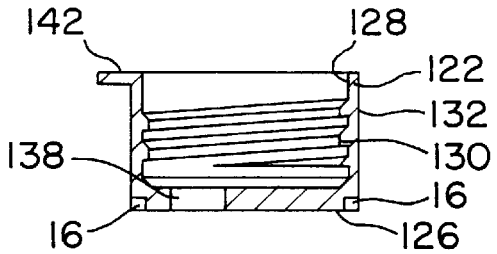
FIG. 4B is a cross-sectional view of the valve of the ink-jet bottle and valve system according to the present invention taken along the line 4B—4B of FIG. 4A.

FIGS. 4A and 4B detail the valve 120 and its elements. Like housing 80, valve 120 is a cylindrical component made of hard plastic or other suitable material compatible with the inks used in ink-jet printers. Suitable materials include, for example, polypropylene and an acetal homopolymer plastic called Delrin® (available from E.I. du Pont de Nemours & Co. of Wilmington, Del.). Valve 120 fits snugly within open chamber 94 of housing 80. Accordingly, the outside diameter of valve 120 is about 30 mm. Because the thickness of wall 122 of valve 120 is about 1 mm, valve 120 defines an open chamber 124 having a diameter of about 28 mm. The external surface 132 of valve 120 is smooth and allows valve 120 to rotate against smooth inside surface 92 of housing 80 and within housing 80. If required, one or more O-rings 16 might be disposed between housing 80 and valve 120 to prevent leakage of ink 12.

The bottom surface 126 of valve 120 is provided with an upper vent 136 and an upper ink passage 138. Upper vent 136 is circular (although other shapes are suitable) and about 5 mm in diameter. Upper ink passage 138 is also circular (although other shapes may work) and about 5 mm in diameter. Both upper ink passage 138 and upper vent 136 are located as shown in FIG. 4A. Specifically, both are off-center. Upper ink passage 138 may be provided with serrations 140 around at least a portion of its circumference. Upper vent 136 and upper ink passage 138 align with lower vent 106 and lower ink passage 108, respectively, when valve 120 is oriented properly within housing 80.

The inside surface 128 of valve 120 has threads 130. Threads 130 engage external threads 22 on bottle 20 to attach the valve assembly to bottle 20. For some applications, it may be desirable to affix valve 120 permanently to bottle 20. (As used in this document, "permanently" means that the force required to separate the valve assembly from bottle 20 is sufficiently large to require deformation or destruction of the valve assembly, bottle 20, or both.) This may be accomplished using any one of a number of conventional techniques such as heat staking, gluing, hot melting, and the like.

Tests were conducted to find a glue suitable to seal together the valve assembly and bottle 20. Three, different types of commercially available glues were tested: a Minute-Bond 312 adhesive comprising methacrylic ester, acrylic acid, and trichloroethylene which is available from Loctite Corporation of Newington, Conn.; a general-purpose hot melt glue; and a special-purpose hot melt glue comprising paraffin wax and phenoxy resin which is called Thermogrip and is available from Bostik Inc. of Middleton, Mass. The Minute-Bond 312 failed to bond samples made of Delrin® material (suitable for the valve assembly) to samples made of either Delrin® or high-density polyethylene (suitable for bottle 20). Both the general-purpose hot melt glue and the special-purpose hot melt glue successfully bonded samples of both Delrin® and polypropylene (suitable for the valve assembly) to samples of high-density polyethylene. The rotational torque required to separate the polyproplyene valve assembly from the high-density polyethylene bottle 20 averaged less than 30 in/lbs (3.4 Nm) when the components were sealed with the general-purpose hot melt glue. The rotational torque required to separate the polyproplyene valve assembly from the high-density polyethylene bottle 20 averaged about 67.5 in/lbs (7.6 Nm) when the components were sealed with the special-purpose hot melt glue. Accordingly, the special-purpose hot melt glue is preferred.

Projecting from the top of valve 120 is a valve rotation limiter or tab 142. Preferably, tab 142 is rectangular and has dimensions 5 mm long (the dimension by which tab 142 projects away from external surface 132 of valve 120) by 6 mm wide. Tab 142 may be between 1 and 2 mm thick; the thickness of tab 142 is equal to the height of valve rotation stops 102, 104 above cutout 100 on top surface 98 of housing 80. An indicator such as arrow 144 may be placed on the top of tab 142 to identify the rotational position of tab 142. When valve 120 fits snugly within open chamber 94 of housing 80, bottom surface 126 of valve 120 engages the bottom of chamber 94 and tab 142 rests in cutout 100.

Tab 142 is used to limit rotation of valve 120 with respect to housing 80. Tab 142 is restricted to a travel path defined by cutout 100 and traverses a path between a first position in which tab 142 abuts one valve rotation stop 102 and a second position in which tab 142 abuts the other valve rotation stop 104. Thus, tab 142 acts as a valve rotation limiter and, in cooperation with valve rotation stops 102 and 104, limits the axial rotation of valve 120 within housing 80. In the first position, upper vent 136 and upper ink passage 138 of valve 120 align with lower vent 106 and lower ink passage 108, respectively, of housing 80. Upper vent 136 and upper ink passage 138 of valve 120 are completely out of alignment with lower vent 106 and lower ink passage 108 of housing 80 when valve 120 is in its second position with tab 142 abutting valve rotation stop 104.

The cam action between valve 120 and housing 80 which occurs as valve 120 rotates relative to housing 80 is preferable to the plunger action by which conventional devices operate. The sliding relationship between valve 120 and housing 80, sealing the vent path and the ink passage, offers several advantages. Specifically, the self-wiping action removes any excess ink 12 during the sealing operation and prevents ink contamination and leakage. That operation is also made more exact and more repeatable because fewer moving parts are required. In addition, valve 120 does not open until ink-jet bottle and valve system 10 is fully seated; valve 120 also closes as the user starts to remove ink-jet bottle and valve system 10 from ink reservoir 32.

Figure 5A:
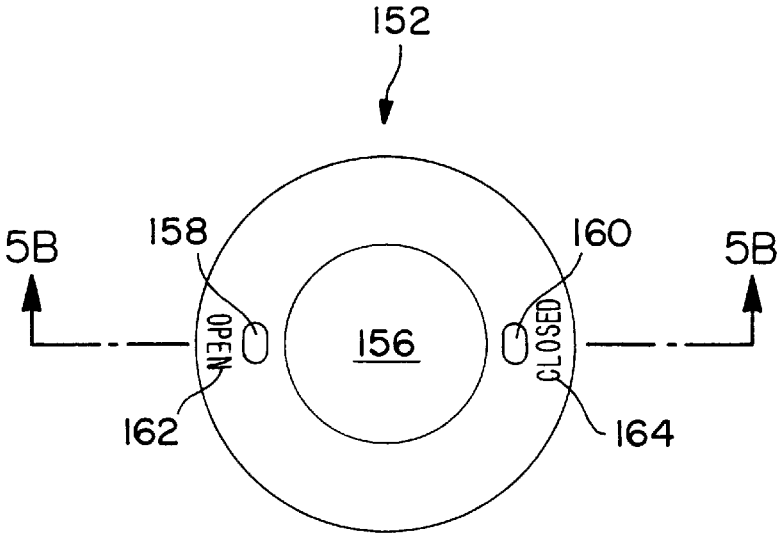
FIG. 5A is a top view of the cover of the ink-jet bottle and valve system according to the present invention.
Figure 5B:
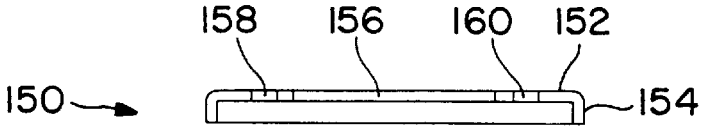
FIG. 5B is a cross-sectional view of the cover of the ink-jet bottle and valve system according to the present invention taken along the line 5B—5B of FIG. 5A.

FIGS. 5A and 5B illustrate the cover 150 used to captivate valve 120 in housing 80 while allowing relative rotation between valve 120 and housing 80. Cover 150 engages flange 86 on housing 80. Preferable, cover 150 "snaps" into position over flange 86 as shown in FIG. 1. Thus, flange 86 provides an attachment surface for cover 150. Specifically, cover 150 has a top 152 and a downwardly extending lip 154. With cover 150 in position over flange 86, the inside surface of lip 154 engages the outside surface of flange 86 while the underside of top 152 engages the top of flange 86.

Top 152 of cover 150 has a central hole 156. Hole 156 has a sufficiently large diameter (e.g., 27 mm) to allow cover 150 to fit loosely over threads 22 on bottle 20. View windows 158 and 160 are provided in top 152 of cover 150. View windows 158 and 160 are provided with labels 162 and 164, respectively, so that indicator 144 (FIG. 4A), when aligned with the appropriate view window 158 or 160, confirms the position of valve 120 relative to housing 80 and, therefore, whether upper vent 136 and upper ink passage 138 of valve 120 are in or out of alignment with lower vent 106 and lower ink passage 108 of housing 80. Consequently, indicator 144 is a marking on valve 120 that aligns with view windows 158 and 160 in cover 150 during rotation of valve 120.

Figure 6:
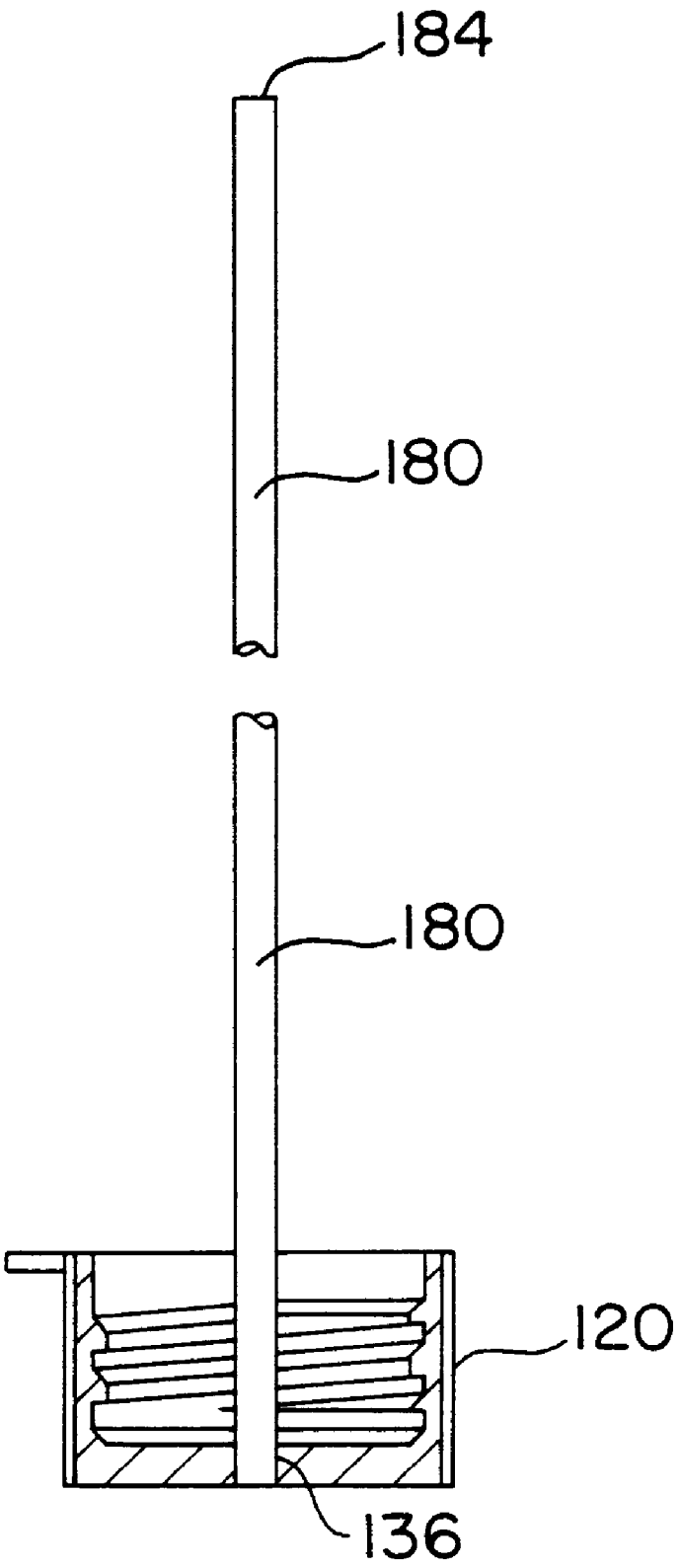
FIG. 6 shows the attachment of the vent tube to the vent according to the present invention.

FIG. 6 shows the attachment of vent tube 180 to upper vent 136 of valve 120. Vent tube 180 may be affixed to upper vent 136 by gluing, staking, or other suitable method. Vent tube 180 allows air, required to equalize the pressure in bottle 20, to pass directly to the area 182 at the top of bottle 20 above ink 12. This allows ink 12 to fill ink reservoir 32 of printer apparatus 30 evenly and quickly. The geometry of vent tube 180 is important to consistent ink performance in printer apparatus 30. Vent tube may be, for example, about 150 mm long with an outside diameter of about 5 mm and an inside diameter of about 4 mm. The length of vent tube 180 must assure that the top 184 of vent tube 180 is in area 182 above the maximum level of ink 12 in bottle 20.

As shown in FIG. 1, the assembled components of ink-jet bottle and valve system 10 define an ink passage that allows the transfer of ink 12 from bottle 20 to ink reservoir 32 of printer apparatus 30. Specifically, ink 12 leaves bottle 20 through upper ink passage 138 of valve 120, enters lower ink passage 108 of housing 80, and passes through channel 84 in nozzle 82 of housing 80 where ink 12 exits ink-jet bottle and valve system 10. The assembled components of ink-jet bottle and valve system 10 also define a vent path which allows air pressure in bottle 20 to equalize during transfer of ink 12. The vent path serves to equalize air pressure inside bottle 20 to the atmospheric pressure inside ink reservoir 32. The vent path includes vent tube 180 (which is affixed inside upper vent 136 of valve 120), lower vent 106, and channel 84 in nozzle 82 of housing 80. The ink passage and the vent path can be interrupted by rotating valve 120 relative to housing 80 so that upper vent 136 and upper ink passage 138 of valve 120 are out of alignment with lower vent 106 and lower ink passage 108 of housing 80.

The size, shape, and position of the vent path and the ink passage are important. Their geometries assure proper sealing of ink-jet bottle and valve system 10, when closed, and consistent ink transfer, when open. Thus, a trade-off exists. Smaller ink passages and vent paths facilitate sealing but restrict ink flow. For the exemplary ink-jet bottle and valve system 10 illustrated and described above, the ink passage is circular (although other shapes may work) and a minimum of about 5 mm in diameter; the vent path is also circular and about 5 mm in diameter. Both the ink passage and vent path are off-center to allow the cam action by which the cover-uncover feature functions as valve 120 rotates within housing 80.

In view of the importance of the size of the vent path and the ink passage, tests were done to identify suitable diameters for the vent path and the ink passage. These diameters must be selected to assure that the flow of ink 12 from bottle 20 into ink reservoir 32 meets the needs of printer 28 yet neither leaks nor overfills ink reservoir 32. Bottle 20 also must not hydrostatically lock when ink level 54 drops below housing 80. Finally, air should enter bottle 20 through the vent path and not via the ink passage. Using a diethylene glycol-based ink solvent, the following tests were conducted:

| TEST No. | INK PATH DIA. (mm) | VENT PATH DIA. (mm) |
|---|---|---|
| 1 | 7.5 | 4.0 |
| 2 | 7.5 | 4.2 |
| 3 | 7.5 | None |
| 4 | 9.5 | 4.4 |
| 5 | 3.2 | 4.8 |
| 6 | 4.8 | 4.8 |

The best results were achieved for test number 6 in which the ink path and the internal diameter of the vent path were both about 4.8 mm.

The operation of ink-jet bottle and valve system 10 of the subject invention will now be described. With the components assembled, as shown in FIG. 1, ink-jet bottle and valve system 10 is ready to attach to printer apparatus 30. As external threaded portion 88 on housing 80 engages threads 46 on ink reservoir 32 and housing 80 screws into printer apparatus 30, the depth of engagement is limited by the contact between bottom surface 96 on housing 80 and neck 44 of printer apparatus 30. After axial rotation of housing 80 has stopped, valve 120 and bottle 20 are allowed limited further rotation until tab 142 on valve 120 contacts valve rotation stop 102 on housing 80. The further rotation of valve 120 and bottle 20 is required to align upper vent 136 and upper ink passage 138 of valve 120 with lower vent 106 and lower ink passage 108, respectively, of housing 80. The vent path and ink passage are now open and ink 12 can flow from bottle 20 into ink reservoir 32.

It is important that bottom surface 96 of housing 80 contacts head 36 of container support portion 38 of printer apparatus 30, fully coupling ink-jet bottle and valve system 10 to printer apparatus 30, before valve 120 rotates with respect to housing 80. According, the "fit" between external threaded portion 88 on housing 80 and threads 46 on ink reservoir 32 must be relatively "loose." By "loose" is meant that a lower torque is required to engage the threads of ink reservoir 32 than the torque required to open the valve assembly.

Indicator 144 on valve 120 informs the operator that the vent path and ink passage are open and that ink 12 is flowing from bottle 20 into ink reservoir 32. Thus, indicator 144 permits verification of proper system-to-printer installation. More generally, alignment of indicator 144, on valve 120, with either view window 158 or 160 in cover 150, shows the condition (open or closed) of ink-jet bottle and valve system 10.

When removal of ink-jet bottle and valve system 10 is desired, the first 180 degrees of "unscrewing" action causes valve 120 and bottle 20 to rotate within housing 80. Once tab 142 on valve 120 contacts valve rotation stop 104 on housing 80, upper vent 136 and upper ink passage 138 of valve 120 are completely out of alignment with lower vent 106 and lower ink passage 108 of housing 80. Ink-jet bottle and valve system 10 is now closed and will not allow ink 12 to flow from bottle 20. Further applied axial torque will break the contact between bottom surface 96 of housing 80 and neck 44 of ink reservoir 32. Still further axial rotation will remove ink-jet bottle and valve system 10 from printer apparatus 30.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention. Specifically, the dimensions provided above for ink-jet bottle and valve system 10 are exemplary only and may vary depending upon the dimensions of printer apparatus 30 to which ink-jet bottle and valve system 10 is attached. The dimensions also may vary depending upon the particular characteristics (e.g., surface tension) of the ink formulation used in connection with printer apparatus 30. Finally, although inks are discussed as the medium for use with ink-jet bottle and valve system 10, other fluids (e.g., solvents, oils, pigments, and the like) could be used.

What is claimed:

1. An ink-jet bottle and supply system delivering ink-jet ink to an ink-jet printer apparatus having an ink reservoir, said ink-jet bottle and supply system comprising:

a bottle containing ink-jet ink and having a neck defining an opening releasing ink from said bottle;

a housing having:

(a) a nozzle extending into said ink reservoir of said ink-jet printer apparatus, said nozzle defining a channel through which ink may flow, (b) an external surface having means for coupling said housing to said in reservoir of said ink-jet printer apparatus, (c) an internal surface defining an open chamber, (d) a top surface having a cutout defining a pair of valve rotation stops, and (e) a bottom surface having a first vent and a first ink passage, each opening to said channel of said nozzle, said bottom surface of said housing contacting said ink reservoir of said ink-jet printer apparatus thereby limiting for coupling between said coupling means on said external surface of said housing and said ink reservoir of said ink-jet printer apparatus;

a valve fitting snugly and rotatably within said open chamber of said housing and having:

(a) an eternal surface, (b) an internal surface having means for coupling said valve to said bottle, (c) a bottom surface having a second vent and a second ink passage, and (d) a top surface having a tab projecting from said top surface, said tab resting in said cutout of said housing and cooperating with said pair of valve rotation stops to limit axial rotation of said valve within said housing between (1) a first position where said tab abuts one of said pair of valve rotation stops and in which said second vent and said second ink passage of said valve align with said first vent and said first ink passage, respectively, of said housing, said valve achieving said first position within said housing only upon rotation of said valve within said housing after said bottom surface of said housing has contacted said ink reservoir, and (2) a second position where said tab abuts the other of said pair of valve rotation stops and in which said second vent and said second ink passage of said valve are out of alignment with said first vent and said first ink passage, respectively, of said housing; and a vent tube affixed to said second vent of said valve.

2. An ink-jet bottle and supply system according to claim 1 wherein said nozzle of said housing defines a central channel extending below said bottom surface of said housing.

3. An ink-jet bottle and supply system according to claim 1 wherein said means for coupling said housing to said ink reservoir of said ink-jet printer apparatus includes a threaded portion on said external surface of said housing adapted to engage a correspondingly threaded aperture of said ink reservoir of said ink-jet printer apparatus.

4. An ink-jet bottle and supply system according to claim 3 wherein said top surface of said housing has a flange and said bottom surface of said housing limits engagement between said threaded portion on said external surface of said housing and said correspondingly threaded aperture of said ink reservoir of said ink-jet printer apparatus.

5. An ink-jet bottle and supply system according to claim 4 further comprising a cover having a central hole fitting loosely over said neck of said bottle, said cover engaging said flange on said housing and captivating said valve within said housing.

6. An ink-jet bottle and supply system according to claim 5 wherein said cover has a top and a pair of view windows provided in said top.

7. An ink-jet bottle and supply system according to claim 6 wherein said tab of said valve has a top wit an indicator aligning with said windows in said cover, said indicator defining the location of said valve relative to said housing.

8. An ink-jet bottle and supply system according to claim 1 wherein said internal surface of said housing is smooth and said external surface of said valve is smooth, said smooth internal surface of said housing and said smooth external surface of said valve permitting rotation of said valve within said housing.

9. An ink-jet bottle and supply system according to claim 1 wherein said top surface of said housing has a circumference and said cutout on said top surface of said housing traverses about one-half of the circumference of said top surface.

10. An ink-jet bottle and supply system according to claim 1 wherein said first vent and said first ink passage of said housing and said second vent and said second ink passage of said valve are all off-center.

11. An ink-jet bottle and supply system according to claim 1 wherein said first vent and said second vent are both circular, each having a diameter of about 5 mm, and said first ink passage and said second ink passage are both circular, each having a diameter of about 7 mm.

12. An ink-jet bottle and supply system according to claim 1 wherein said first ink passage and said second ink passage each have a periphery and serrations disposed along at least a portion of the periphery.

13. An ink-jet bottle and supply system according to claim 1 wherein said neck of said bottle is threaded.

14. An ink-jet bottle and supply system according to claim 13 wherein said means for coupling said valve to said bottle includes threads on said internal surface of said valve engaging said threaded neck on said bottle.

15. An ink-jet bottle and supply system according to claim 1 further comprising means for permanently affixing said valve to said bottle.

16. An ink-jet bottle and supply system delivering ink-jet ink to an in-jet printer apparatus having an ink reservoir with a head and a neck extending upwardly from said head and defining a threaded aperture, said ink-jet bottle and supply system comprising:

a bottle containing ink-jet ink and having a neck defining an opening releasing in from said bottle;

a housing having:

(a) a nozzle extending into said in reservoir of said ink-jet printer apparatus, said nozzle defining a central channel through which ink may flow, (b) an external surface having a threaded portion adapted to engage said threaded aperture of said ink-jet printer apparatus and coupling said housing to said ink reservoir of said in-jet printer apparatus, (c) a smooth internal surface defining an open chamber, (d) a top surface having a circumference, a cutout traversing about one-half of said circumference and defining a pair of valve rotation stops, and a flange, and (e) a bottom surface having a first vent and a first ink passage each opening to said channel of said nozzle, said first vent and said first ink passage each disposed off center, said bottom surface limiting engagement between said threaded portion on said external surface of said housing and said threaded aperture of said ink reservoir of said ink-jet printer apparatus;

a valve fitting snugly and rotatably within said open chamber of said housing and having:

(a) a smooth external surface, said smooth internal surface of said housing and said smooth external surface of said valve permitting rotation of said valve within said housing;

(b) an internal surface having threads engaging said threaded aperture in said neck of said bottle and coupling said valve to said bottle, (c) a bottom surface having a second vent and a second ink passage, said second vent and said upper second ink passage each disposed off center, and (d) a top surface having a tab projecting from said top surface, said tab having a top with an indicator and resting in said cutout of said housing and cooperating with said pair of valve rotation stops to limit axial rotation of said valve within said housing between (1) a first position where sand tab abuts one of said pair of valve rotation stops and in which said second vent and said second ink passage of said valve align with said first vent and said first ink passages respectively, of said housing, said valve achieving said first position within said housing only upon rotation of said valve within said housing after said bottom surface of said housing has limited engagement between said treaded portion on said external surface of said housing and said threaded aperture of said ink reservoir of said ink-jet printer apparatus, and (2) a second position where said tab abuts the other of said pair of valve rotation stops and in which said second vent and said second ink passage of said valve are out of alignment with said first vent and said first in passage, respectively, of said housing;

a cover having a central hole fitting loosely over said neck of said bottle, a top, and a pair of view windows provided in said top aligning with said indicator on said top of said tab and confirming the location of said valve relative to said housing, said cover engaging said flange on said housing and captivating said valve within said housing; and a vent tube affixed to said second vent of said valve.

17. An ink-jet bottle and supply system according to claim 16 wherein said first vent and said second vent are both circular, each having a diameter of about 5 mm, and said first ink passage and said second ink passage are bottle circular, each having a diameter of about 7 mm.

18. An ink-jet bottle and supply system according to claim 16 wherein said first ink passage and said second ink passage each have a periphery and serrations disposed along at least a portion of the periphery.

19. An ink-jet bottle and supply system according to claim 16 further comprising means for permanently affixing said valve to said bottle.

20. An ink-jet system comprising:

an ink-jet printer apparatus including:

(a) a print head;

(b) a ink supply base defining an ink reservoir containing a supply of ink, said ink supply base including means for coupling said ink supply base to an ink-jet bottle and supply system, and (c) means for delivering ink from said ink reservoir to said print head; and an ink-jet bottle and supply system including:

(a) a bottle containing ink-jet ink and having an opening releasing ink from said bottle, (b) a housing having:

(i) a nozzle extending into said ink reservoir of said ink-jet printer apparatus, said nozzle defining a channel through which ink may flow;

(ii) an external surface having means for coupling said housing to said ink reservoir of said ink-jet printer apparatus;

(iii) an internal surface defining an open chamber;

(iv) a top surface having a cutout defining a pair of valve rotation stops; and (v) a bottom surface having a first vent and a first ink passage each opening to said channel of said nozzle, said bottom surface of said housing contacting said ink reservoir of said ink-jet printer apparatus thereby limiting further coupling between said coupling means on said external surface of said housing and said ink reservoir of said ink-jet printer apparatus, (c) a valve fitting snugly and rotatably within said open chamber of said housing and having:

(i) an external surface;

(ii) an internal surface having means for coupling said valve to said bottle;

(iii) a bottom surface having a second vent and a second ink passage; and (iv) a top surface having a tab projecting from said top surface, said tab resting in said cutout of said housing and cooperating with said pair of valve rotation stops to limit axial rotation of said valve within said housing between (1) a first position where said tab abuts one of said pair of valve rotation stops and in which said second vent and said second ink passage of said valve align with said first vent and said first ink passage, respectively, of said housing, said valve achieving said first position within said housing only upon rotation of said valve within said housing after said bottom surface of said housings contacted said ink reservoir, and (2) a second position where said tab abuts the other of said pair of valve rotation stops and in which said second vent and said second ink passage of said valve are out of alignment with said first vent and said first ink passage, respectively, of said housing, and (d) a vent tube affixed to said second vent of said valve.

* * * * *

UNITED STATES PATENT AND TRADEMARK OFFICE

CERTIFICATE OF CORRECTION

PATENT NO. : 5,903,293

DATED : May 11, 1999

INVENTOR(S) : Ben K, Nikkels, et al

It is certified that error appears in the above-indentified patent and that said Letters Patent is hereby corrected as shown below:

In column 3, line 28, delete "um" and insert —minimum—.

In column 6, line 1, delete "filly" and insert —fully—.

In column 10, claim 1, line 37, delete "in" and insert —ink—.

In column 10, claim 1, line 46, delete "for" and insert —further—.

In column 11, claim 7, line 32, delete "wit" and insert —with—.

In column 12, claim 16, line 14, delete "in-jet" and insert —ink-jet—.

In column 12, claim 16, line 38, delete "upper".

In column 12, claim 16, line 45, delete "sand" and insert —said—.

UNITED STATES PATENT AND TRADEMARK OFFICE

CERTIFICATE OF CORRECTION

PATENT NO. : 5,903,293

DATED : May 11, 1999

INVENTOR(S) : Ben K, Nikkels, et al

It is certified that error appears in the above-indentified patent and that said Letters Patent is hereby corrected as shown below:

In column 12, claim 16, line 53, delete "treaded" and insert —threaded—.

In column 13, claim 20, line 17, delete "a" and insert —an—.

Signed and Sealed this

Ninth Day of November, 1999

*Attest:*

Q. TODD DICKINSON

*Attesting Officer*

*Acting Commissioner of Patents and Trademarks*